US005229729A

United States Patent [19]

Nishikawa et al.

[11] Patent Number: 5,229,729

[45] Date of Patent: Jul. 20, 1993

[54] RADIO FREQUENCY SIGNAL COMBINING/SORTING APPARATUS

[75] Inventors: Toshio Nishikawa; Youhei Ishikawa; Koichi Takehara, all of Nagaokakyo, Japan

[73] Assignee: Murata Manufacturing Co., Ltd., Japan

[21] Appl. No.: 913,772

[22] Filed: Jul. 13, 1992

Related U.S. Application Data

[63] Continuation of Ser. No. 628,478, Dec. 14, 1990, abandoned.

[30] Foreign Application Priority Data

Dec. 14, 1989 [JP] Japan ..... 1-325536
Dec. 21, 1989 [JP] Japan ..... 1-331611

[51] Int. Cl.[5] ..... H01P 1/213

[52] U.S. Cl. ..... 333/126; 333/134; 333/219.1

[58] Field of Search ..... 333/126, 129, 132-135, 333/202, 219.1

[56] References Cited

U.S. PATENT DOCUMENTS

| | | | |
|---|---|---|---|
| 3,124,768 | 3/1964 | Tilston | 333/126 |
| 3,865,990 | 2/1975 | Kuenemund | 333/134 X |
| 4,639,699 | 1/1987 | Nishikawa et al. | 333/219.1 X |
| 5,015,974 | 5/1991 | Komazaki et al. | 333/134 |
| 5,021,756 | 6/1991 | Tajima et al. | 333/132 |
| 5,034,707 | 7/1991 | Kagstrom | 333/126 |

FOREIGN PATENT DOCUMENTS

| | | |
|---|---|---|
| 1963422 | 12/1969 | Fed. Rep. of Germany . |
| 1277667 | 6/1972 | United Kingdom . |
| 2203898 | 3/1988 | United Kingdom . |

OTHER PUBLICATIONS

Microwave Journal, vol. 32, No. 6, Jun. 1989, Dedham U.S., pp. 99-112; Levinson and Bennett: "Multiplexing With High Performance Directional Filters", pp. 108-110; Figure 8.

Microwave Journal, vol. 30, No. 11, Nov. 1987, Dedham U.S., pp. 79-86; Levy: "A New Adaptive Filter-/IFM Receiver System", the whole document.

39th IEEE Vehicular Technology Conference, vol. I, May 1989, San Francisco, U.S. pp. 353-358; Clark: "Cellular Rural Statistical Area (RSA) Transmit And Combining", p. 355 and Fig. 5.

*Primary Examiner*—Paul Gensler

*Attorney, Agent, or Firm*—Ostrolenk, Faber, Gerb & Soffen

[57] ABSTRACT

A radio frequency signal combining/sorting apparatus which includes a plurality of channel filters which allow band regions of respective transmission channels to pass through them, isolators connected to respective inputs of the channel filters, a plurality of sets of power composing circuits each including branch lines for composing outputs of the channel filters into one output, and hybrid circuits arranged to each compose the outputs per two sets of the power composing circuits. The band regions to be applied to the respective channel filters are selected in such relation that the band regions of the respective channel filters corresponding to a given power composing circuit are spaced from each other to the largest possible extent.

21 Claims, 16 Drawing Sheets

RADIO FREQUENCY SIGNAL COMBINING/SORTING APPARATUS

This is a continuation of application Ser. No. 07/628,478 filed on Dec. 14, 1990, now abandoned.

BACKGROUND OF THE INVENTION

The present invention generally relates to communication equipment and more particularly, to a radio frequency signal combining/sorting apparatus which composes (combines) a plurality of transmission signals for transmission to a common output line or antenna.

A recent trend, in mobile unit communication systems such as automobile telephones, etc. utilizing a frequency band region of 800 MHz has been to employ, a so-called, cellular system, in which a number of radio frequency channels corresponding to the radio traffic capacity of the cells (wireless zones) are provided in one base station.

By way of example, in a mobile unit communication system for an automobile telephone or the like, which recently has experienced a rapid increase in the number of users, a large number of channels, as many as 32 to 64 channels for example, are required in one base station.

In a case where so many radio frequency channels are to be provided in one base station, the use of an antenna sharing technique at the base station is essential from an economical point of view, and development of an efficient radio frequency signal combining/sorting apparatus for combining many input signals into one output signal has been strongly demanded.

The radio frequency signal combining/sorting apparatus disclosed herein is not limited in its application to such an antenna sharing device as referred to above, but may also be employed generally in a power composing (combining) device having a construction as shown in FIG. 15 or 16.

In FIG. 15, a known power combining device PA includes so-called 3dB hybrid circuits H1,H2 and H3 connected to each other and respectively grounded through resistors R1,R2 and R3 which serve as dummy loads, input terminals IN1 and IN2 for the 3dB hybrid circuit H1, input terminals IN3 and IN4 for the 3dB hybrid circuit H2, and an output terminal OUT led out from the 3dB hybrid circuit H3.

In the above arrangement PA, the 3dB hybrid circuit H1 combines the power of the signals inputted to the input terminals IN1 and IN2 for application to one input of the 3dB hybrid circuit H3, while the 3dB hybrid circuit H2 combines the power of the signals inputted to the input terminals IN3 and IN4 to be applied to the other input of said 3dB hybrid circuit H3. Thus, the 3dB hybrid circuit H3 subjects the both signals thus inputted to power combination and outputs the same.

Another known power composing device PB in FIG. 16 includes input terminals IN1,IN2,—and INn respectively coupled to channel filters F1,F2,—and Fn each constituted by a band-pass filter, through isolators I1-,I2,—and In, a power composing circuit (or junction unit) JU coupled with said channel filters F1,F2,—and Fn, and an output terminal OUT led out from the circuit JU.

In the power composition circuit PB as described above, respective signals inputted to the input terminals IN1,IN2,—and INn are prevented from mixing with other inputs by the isolators I1,I2,—and In, and the signals passing through channel filters F1,F2,—and Fn are subjected to power composition by the junction unit JU for output-therefrom through the output terminal OUT.

The so-called 3dB hybrid composing system shown in FIG. 15 is a simplified system, without frequency characteristics in principle. However, since half of the power is absorbed by dummy loads each time the power passes through the 3dB hybrid circuit, it is not generally used as the signal combining/sorting apparatus for effecting power transmission.

On the other hand, the so-called junction unit composing system shown in FIG. 16, which employs the channel filters for passing the respective band regions of the predetermined channel frequencies by inputting signals of the corresponding channels, the power composition may be effected with a small sharing loss. Therefore, this system is generally employed as the radio frequency signal combining/sorting apparatus.

The relationship between the respective channels and transmission characteristics of the respective channels are shown in a graphical diagram of FIG. 17, in which center frequencies of the respective channels and channel filters are represented by f1,f2,f3,—and fn. As is seen from FIG. 17, in order to reduce interference with respect to neighboring channels, a Q value above a predetermined constant value is also necessary, while high frequency temperature stability is required for suppressing any increase of the insertion loss due to displacement of the central frequency by temperature changes. However, in a case where the arrangement is applied to a system as having a channel interval of 100 KHz, for example, in a band region of 800 MHz to 1.5 GHz, it is difficult to construct a channel filter having a stable frequency characteristic, with a high Q value, maintained even in a cavity resonator, semi-coaxial cavity resonator or dielectric resonator, etc., and thus, an increase in the insertion loss can not be avoided.

SUMMARY OF THE INVENTION

Accordingly, an essential object of the present invention is to provide a radio frequency signal combining/sorting apparatus which is so arranged to be able to employ channel filters not provided with very high Q value and frequency temperature stability, and yet, to be applicable to a system having many channels, with small channel intervals.

Another object of the present invention is to provide a radio frequency signal combining/sorting apparatus of the above described type in which resonators used therein as channel filters are further reduced in size so as to achieve compact size, low loss and cost reduction of the apparatus as a whole including composite parts.

In accomplishing these and other objects, according to one preferred embodiment of the present invention, there is provided a radio frequency signal combining/sorting apparatus which includes a plurality of channel filters which allow band regions of respective transmission channels to pass therethrough, isolators connected to respective inputs of said channel filters, a plurality of sets of power composing circuits including branch lines for composing outputs of said channel filters as one output, and hybrid circuits arranged to compose outputs of respective groups of said power composing circuits. The band regions of said respective channel filters are selected so that the band regions of the respective channel filters of a given power composing circuit are spaced from each other to a largest possible extent.

By the arrangement of the present invention as described above, the band regions of the respective channel filters connected to a given power composing circuit are allocated to every other channel alternately. Therefore, the effective channel intervals between the respective signals inputted to the given power composing circuit are doubled thereby to reduce interference with respect to the neighboring channels. Therefore, the requirements as to Q value and frequency temperature stability of the respective channel filters are alleviated. On the contrary, even in the case where channel filters provided with the same Q value and frequency temperature stability are employed, it becomes possible to apply the invention to make possible a system in which a larger number of channels may be handled, even if they have small channel intervals.

In another embodiment of the present invention, there is also provided a radio frequency signal combining/sorting apparatus which includes a channel filter unit formed with signal input coupling means receiving holes and signal output coupling means receiving holes, and provided with a plurality of TM mode dielectric resonators respectively adapted to allow band regions of specific channels to pass therethrough. The dielectric resonators are arranged to have a common plane at least with said signal output coupling means receiving holes and a junction unit having a circuit board with signal output coupling means which project from the surface thereof, and on which branched lines including transmission lines for composing outputs of said signal output coupling means are provided. The junction unit is combined with said channel filter unit to constitute said radio frequency signal combining/sorting apparatus.

The radio frequency signal combining/sorting apparatus in the above embodiment of the present invention, is broadly divided into the channel filter unit and the junction unit each having constructions as described above, which are combined with each other to provide one radio frequency signal combining/sorting apparatus.

In the case where radio frequency signal combining/sorting apparatus is used for a cellular base station, since the power required for transmission is comparatively lowered following reduction of the cell radius in recent years, compact dielectric resonators with a small power capacity may be employed. Generally, TM mode dielectric resonators such as $TM_{010}$ and $TM_{110}$ modes, etc., can be used although the Q value is slightly low as compared with that of a dielectric resonator of the $TE_{018}$ mode, when the dielectric resonator is to be reduced in size, the TM mode dielectric resonator is capable of maintaining a high Q value as compared with the TE mode dielectric resonator. Accordingly, the channel filter unit may be compact in size and have a low insertion loss.

Moreover, since the signal output coupling means to be coupled with the outputs of the respective dielectric resonators of the channel filter unit is integrally formed with the junction unit, by combining the junction unit into one unit with the channel filter unit, a radio frequency signal combining/sorting apparatus still more reduced in size on the whole may be constituted.

BRIEF DESCRIPTION OF THE DRAWINGS

These and other objects features of the present invention will become apparent from the following description of several preferred embodiments thereof with reference to the accompanying drawings, in which.

DETAILED DESCRIPTION OF THE INVENTION

Figure 1:
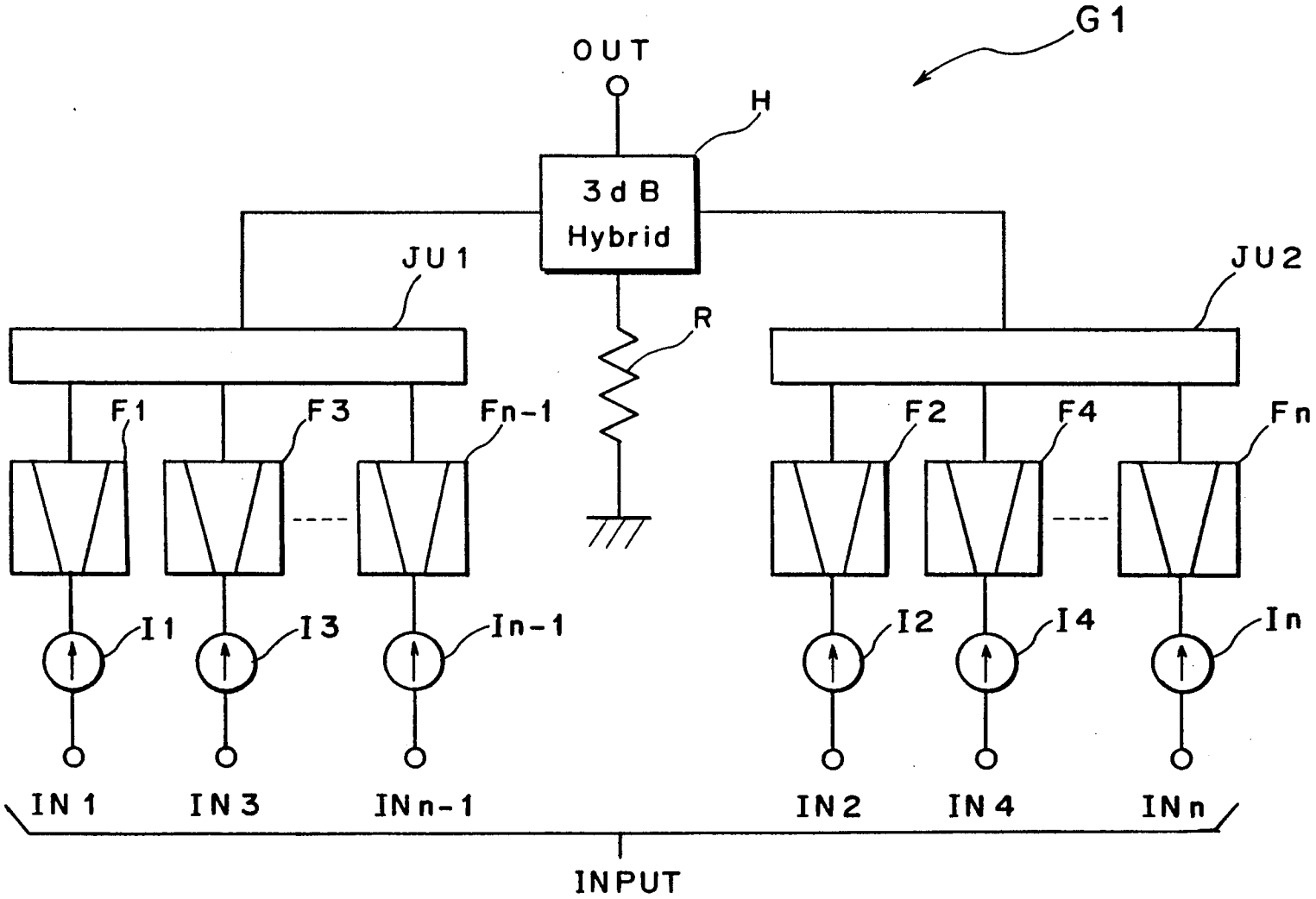
FIG. 1 is a schematic circuit diagram showing the construction in principle of a radio frequency signal combining/sorting apparatus according to an embodiment of the present invention.

Before the description of the present invention proceeds, it is to be noted that like parts are designated by like reference numerals throughout the accompanying drawings.

Principle of the Present Invention

Referring now to the drawings, there is shown in FIG. 1 a schematic circuit diagram representing a general construction in principle, of a radio frequency signal combining/sorting apparatus G1 according to the present invention, which generally includes channel filters F1,F3,—and Fn-1, and F2,F4,—and Fn which respectively allow band regions of allocated transmission channels to pass therethrough, isolators I1,I3,—and In-1, and I2,I4,—and In connected to inputs of the respective channel filters, a power composing circuit JU1 (Junction unit) connected to outputs of the channel filters F1,F3,—and Fn-1 and constituted by branch lines for composing the respective outputs as one output, another power composing circuit JU2 (Junction unit) connected to outputs of the channel filters F2,F4,—and Fn and constituted by other branch lines and a 3dB hybrid circuit H connected to outputs of said power composing circuits JU1 and JU2 and grounded through a resistor or dummy load R.

In the above arrangement according to the present invention, the signals inputted from the input terminals IN1,IN3,—and INn-1 are filtered by the channel filters F1,F3,—and Fn-1 independently of the signals inputted from the input terminals IN2,IN4,—and In so as to be composed as one output by the power composing circuit JU1. Meanwhile, the signals inputted from the input terminals In2,In4,—and INn are filtered by the channel filters F2,F4,—and Fn independently of the signals inputted from the input terminals In1, IN3,—and INn-1, so as to be composed as one output by the power composing circuit JU2. Thus, these two outputs are composed as one output by the 3dB hybrid circuit H.

Figure 2:
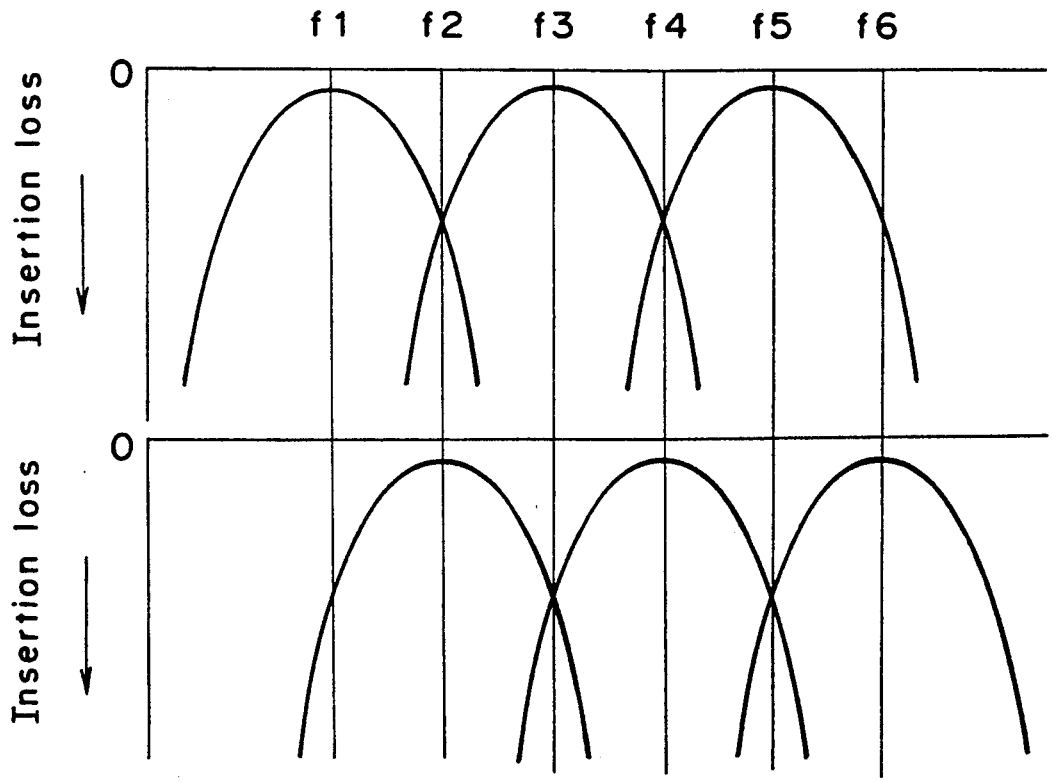
FIG. 2 is a diagram showing transmission characteristics of the respective channel filters shown in FIG. 1.

FIG. 2 shows transmission characteristics of the channel filters F1 to F6 which are a subset of the channel filters F1 to Fn. Here, f1 to f6 correspond to the resonance frequencies of the channel filters F1 to F6. The transmission characteristics of the channel filters at the side connected to the power composing circuit JU1 are shown in the upper part of FIG. 2, while those of the filters at the side connected to the power composing circuits JU2 are shown in the lower part of FIG. 2. Thus, the band regions of the respective channel filters connected to one power composing circuit are alternately allocated to every other channel. Therefore, the interval between the respective signals inputted to one power composing circuit is enlarged, namely doubled, namely, thereby reducing interference caused by each channel with respect to the neighboring channels. Accordingly, the requirements of Q value and frequency temperature stability for the respective channel filters may be alleviated. Conversely, even in a the case where channel filters provided with the conventional Q value and frequency temperature stability are employed, they can be applied to a system having more channels arranged with narrower channel intervals than in the conventional system.

It is to be noted here that, in the foregoing arrangement, due to the function of the hybrid circuit H and the dummy load R, although the power to be outputted becomes half the total composite power outputted by the two power composing circuits JU1 and JU2. However, since the insertion loss in the respective filters is reduced as compared with the case where only the conventional simple junction unit composing system is employed, it becomes possible to effect power composition at a low insertion loss on the whole.

First Embodiment

Figure 3:
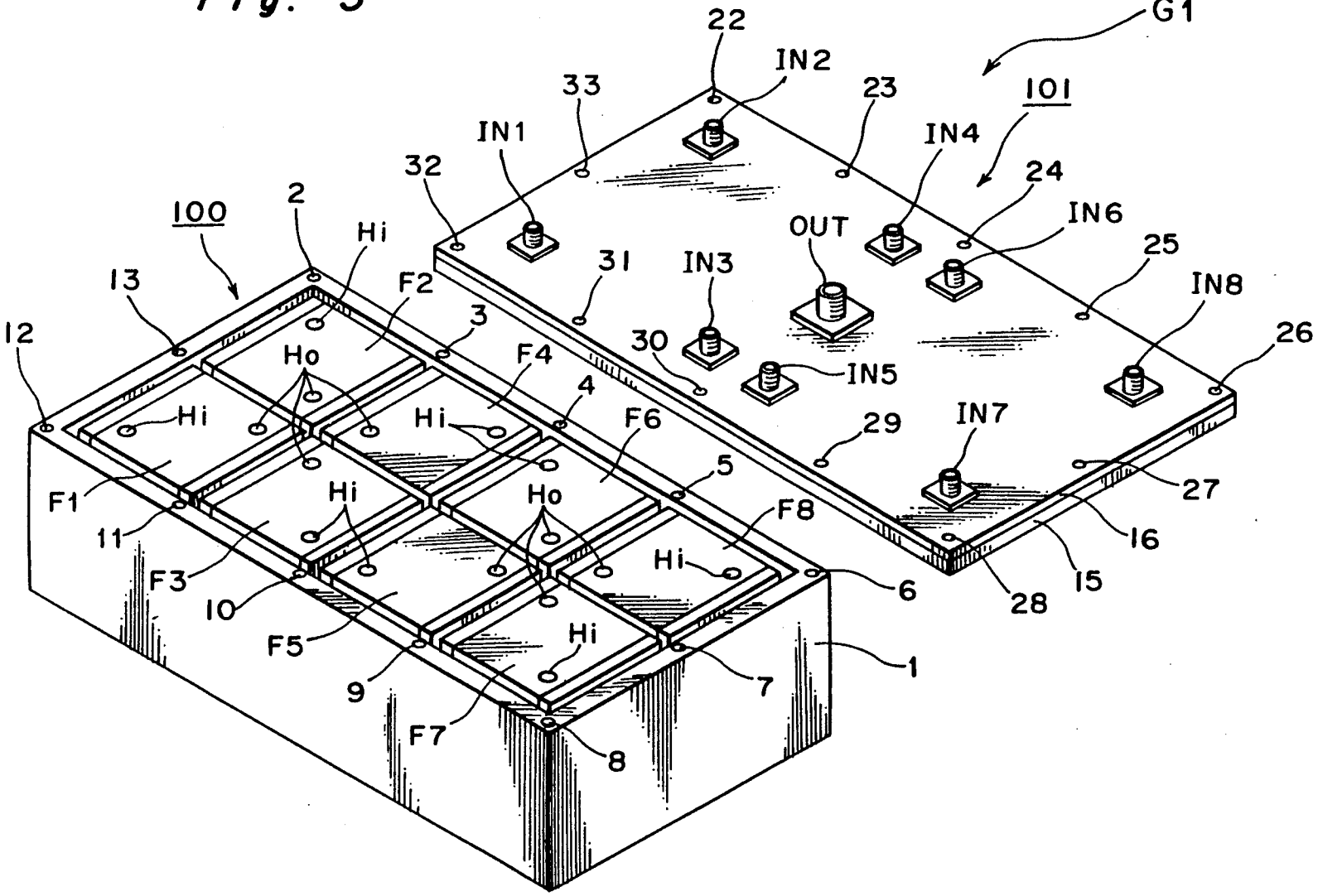
FIG. 3 is a perspective exploded view of a radio frequency signal combining/sorting apparatus according to one preferred embodiment of the present invention, with its channel filter unit and junction unit shown as separated from each other.
Figure 4:
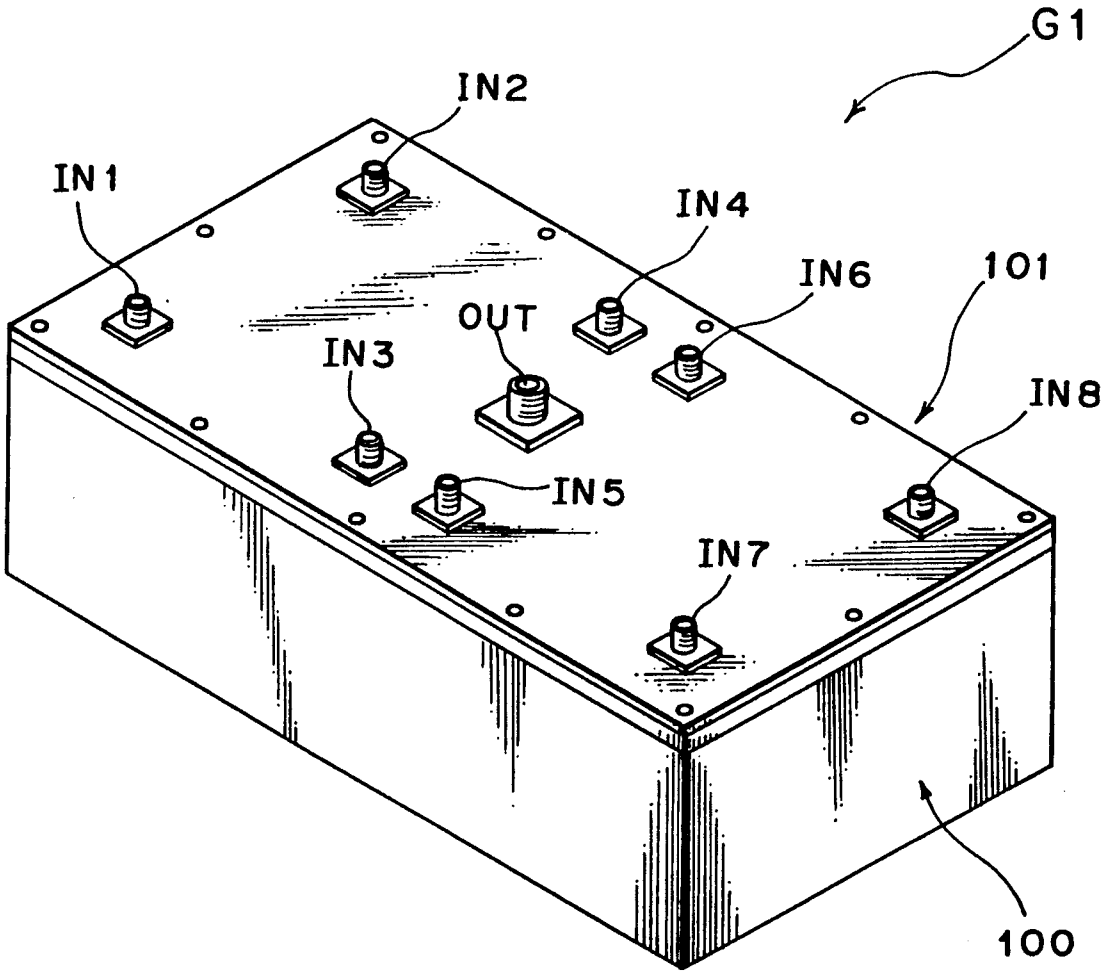
FIG. 4 is also a perspective view of the combining/sorting apparatus of FIG. 3, with its channel filter unit and junction unit combined with each other to constitute said apparatus.

FIGS. 3 to 8(C) show constructions of a radio frequency signal combining/sorting apparatus according to one preferred embodiment of the present invention, FIG. 3 is a perspective exploded view of the radio frequency signal combining/sorting apparatus G1, with its channel filter unit and junction unit shown as separated from each other, and FIG. 4 is a perspective view of the combining/sorting apparatus G1 of FIG. 3, with its channel filter unit and junction unit combined with each other to constitute the entire apparatus.

In FIG. 3, the radio frequency signal combining/sorting apparatus G1 generally includes a channel filter unit 100 and a junction unit 101 shown as separated from each other for clarity. The channel filter unit 100 further includes a metallic case 1 of a rectangular cubic box-like configuration open at its upper portion and eight TM mode dielectric resonators F1 to F8 accommodated in said case 1. Each of these dielectric resonators F1 to F8 is constituted by a cavity having metallized ceramic material of a hexahedron configuration and a dielectric member having a square pillar shape provided in said cavity, as will be described in more detail later. On the upper surfaces of the respective dielectric resonators F1 to F8 in FIG. 3, there are formed signal input coupler inserting holes Hi and signal output coupler inserting holes Ho. Moreover, on peripheral edges around the upper opening of the case 1, threaded holes 2 to 13 are formed to receive screws for fixing the junction unit 101.

The junction unit 101 shown in FIG. 3 is mainly constituted by two substrates 15 and 16 of ceramic material, branch lines formed between said two substrates, signal input coupling means, signal output coupling means, and input and output connectors to be mentioned hereinbelow. In FIG. 3, the ceramic substrates 15 and 16 are mounted with eight signal input connectors IN1 to IN8 and one signal output connector indicated by OUT on the upper surface thereto. On the peripheral edge of the substrates 15 and 16, holes 22 to 33 are formed in positions corresponding to the threaded holes 2 to 13 for fixing the junction unit 101 onto the channel filter unit 100 by screws (not shown).

When assembled, the channel filter unit 100 and the junction unit 101 are combined as shown in FIG. 4, thereby to constitute the eight channel radio frequency signal combining/sorting apparatus G1.

Now, the construction of one of the dielectric resonators employed in the channel filter unit 100 will be explained with reference to FIGS. 5 and 6.

Figure 5:
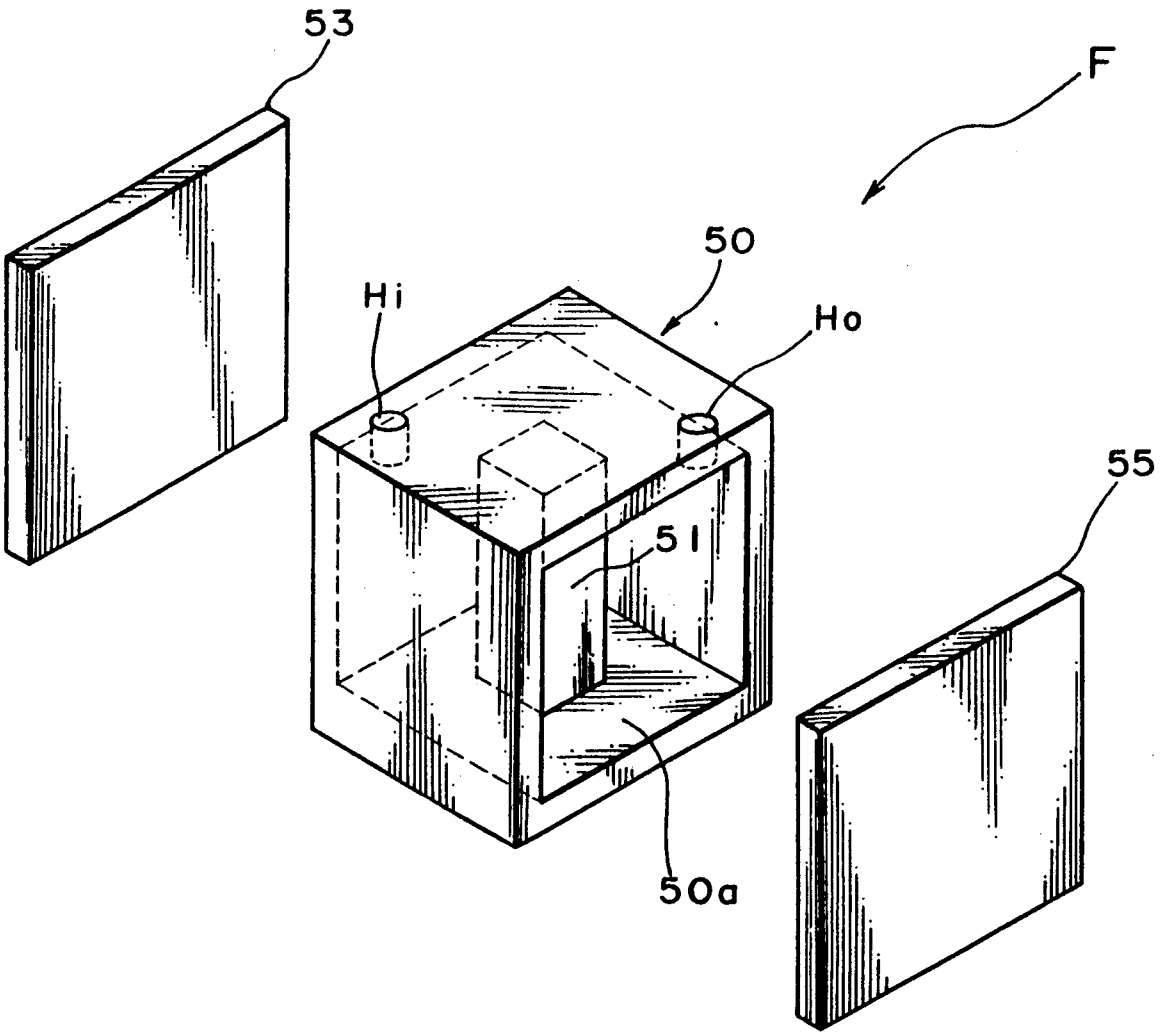
FIG. 5 is a schematic exploded perspective view showing the construction of a dielectric resonator representing one of the channel filters employed in the arrangement of FIGS. 3 and 4.

In the schematic exploded perspective view of FIG. 5, the dielectric resonator represented as F includes a square ceramic member 50 having a square box-like configuration open at opposite sides, and metallized on the outer sides thereof, with a square pillar-like inner dielectric member 51 being integrally formed with a bottom 50*a* of the ceramic member 50, and ceramic side plates 53 and 55 metallized on inner faces thereof facing the open sides of the ceramic member 50. When the ceramic member 50 and the side plates 53 and 55 are combined, a dielectric resonator having a ceramic cavity is constituted. Moreover, on the upper surface of the ceramic member 50, the holes Hi and Ho for receiving the signal input coupling means and signal output coupling means are formed.

Figure 6:
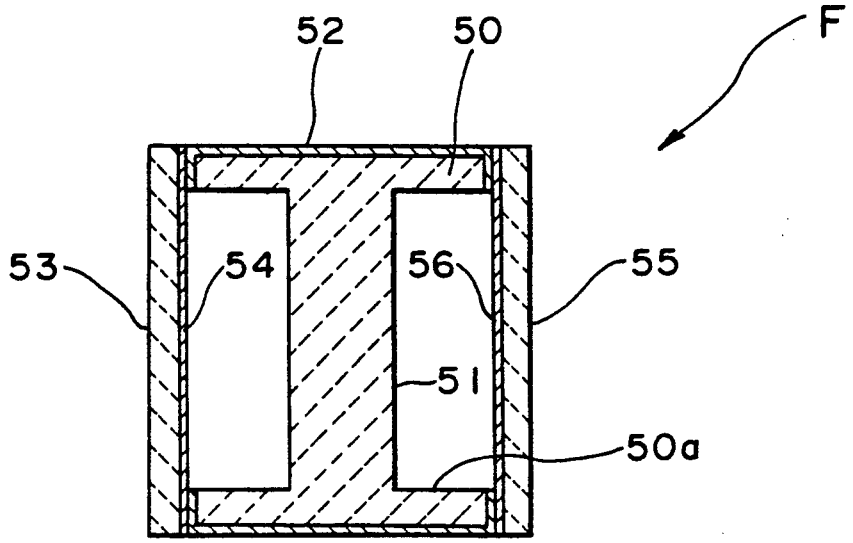
FIG. 6 is a cross sectional view of the channel filter of FIG. 5 as assembled.

FIG. 6 shows the cross section of the one dielectric resonator F of FIG. 5 after assembly, in which a shielded cavity is formed by an electrode layer 52 formed on the outer side of the ceramic member 50, and electrodes 54 and 56 formed in the inner faces of the ceramic side plates 53 and 55. By the functions of said cavity and the inner dielectric member 51, the resonator functions as a $TM_{110}$ mode dielectric resonator.

Now, construction of the junction unit 101 will be described with reference to FIGS. 7 to 8(C).

Figure 7:
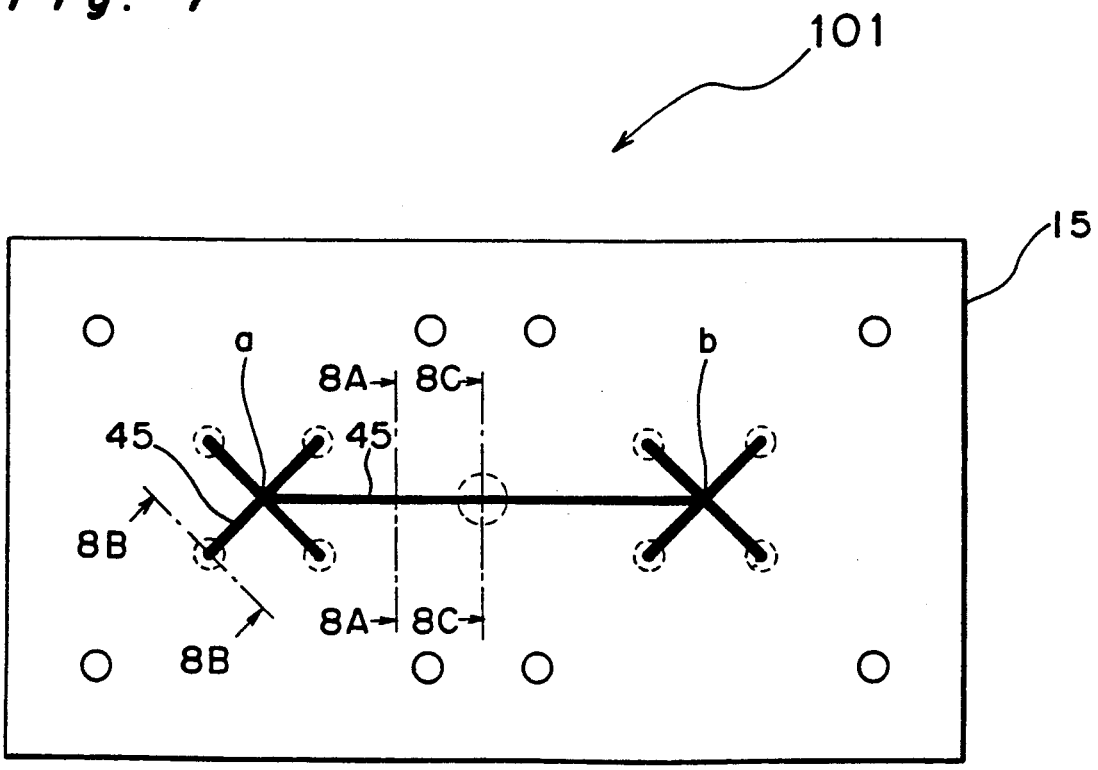
FIG. 7 is a schematic top plan view for explaining the construction of the junction unit.

FIG. 7 shows the branch lines formed over the upper surface of the ceramic substrate 15 which particularly comprises transmission lines. In FIG. 7, a so-called Tri-Plate (trademark) type transmission line is indicated by numeral 45.

Figure 8B:
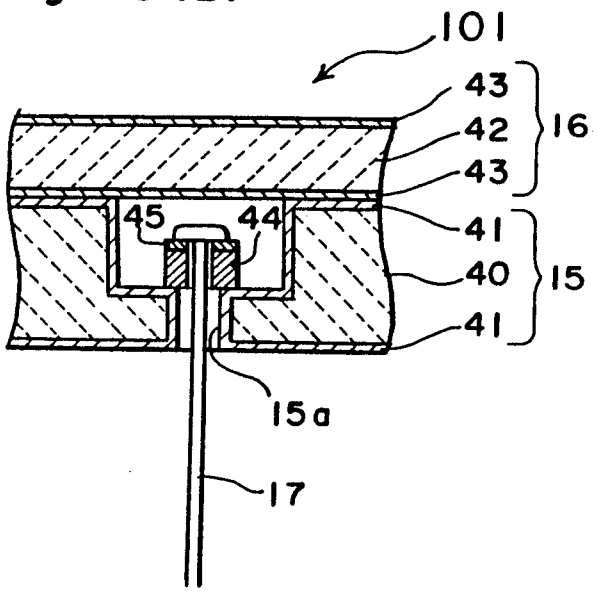
FIGS. 8(A) to 8(C) are fragmentary cross sections on an enlarged scale, taken along the lines 8A—8A, 8B—8B, and 8C—8C in the junction unit of FIG. 7.
Figure 8A:
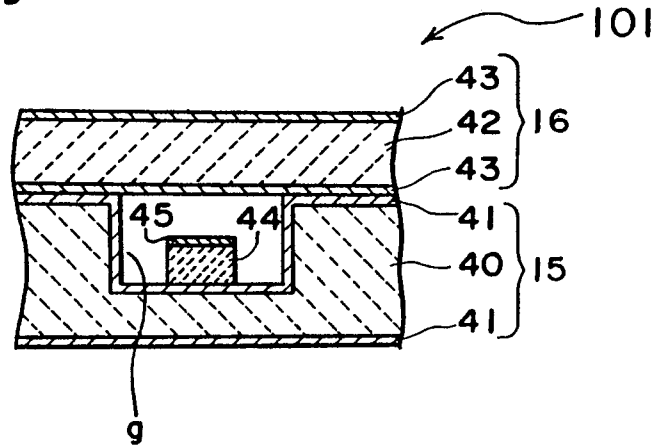
Figure 8C:
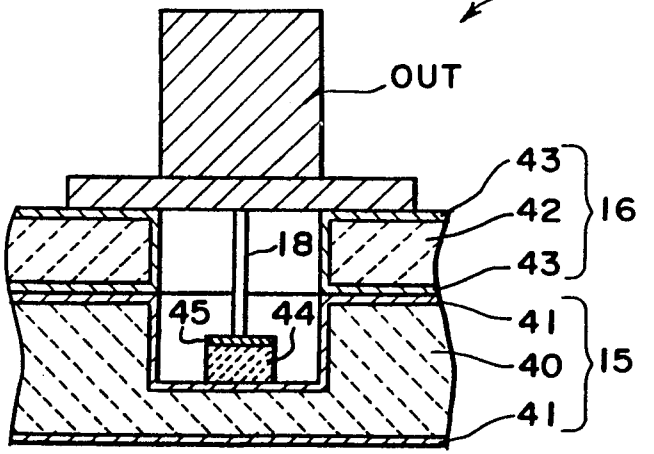

FIGS. 8(A), 8(B) and 8(C) respectively show fragmentary cross sections taken along the lines 8A—8A, 8B—8B, and 8C—8C in FIG. 7.

In FIG. 8(A) showing the cross section along the line 8A—8A at the transmission line portion, the ceramic substrate 15 is constituted by forming electrode layers 41 over upper and lower surfaces of a ceramic plate 40, while the other ceramic substrate 16 is also composed by forming electrode layers 43 over upper and lower surfaces of a ceramic plate 42. In a predetermined portion of the ceramic substrate 15, a groove g is formed, along which groove, a dielectric member 44 is provided, with an electrode 45 further formed on the dielectric member 44 as shown. This electrode 45 constitutes a Tri-Plate (trademark) type transmission line together with the electrode 41 of the ceramic substrate 15, and the electrode 43 of the ceramic substrate 16. FIG. 8(B) shows the cross section at the location where the signal output coupling means is provided (the cross section along the line 8B-8B in FIG. 7). As shown in FIG. 8(B), a through-hole 15*a* is formed at a predetermined portion of the ceramic substrate 15, and a coupling probe (i.e. signal output coupling means) 17 is extended through the dielectric member 44 and the electrode layer 45, with the end portion of the probe 17 projecting from the undersurface of the ceramic substrate 15 via the through-hole 15*a*.

FIG. 8(C) shows the cross section at the location of the output connector (taken along the line 8C—8C in FIG. 7). At this location, an opening is formed in the ceramic substrate 16, and the output connector OUT is mounted on the upper surface of the ceramic substrate 16, with a central conductor 18 of said connector being connected to the electrode 45 as illustrated.

Moreover, at the mounting locations of the respective input connectors, through-holes are formed in the ceramic substrates 15 and 16, and central conductors of the respective input connectors extend through the under surface of the substrate 15 as the signal input coupling means such as the coupling probes, coupling loops, etc.

By applying and fixing the junction unit 101 having the construction as described above onto the channel filter unit 100, the coupling probes 17 projecting from the undersurface of the junction unit 101 are inserted into the signal output coupling means insertion holes Hoof the respective dielectric resonators, while the central conductors of the respective signal input connectors IN are inserted into the signal input coupling means insertion holes Hi of the respective dielectric resonators. Accordingly, the signals for the respective channels are inputted from the signal input connectors IN to the respective corresponding dielectric resonators, and the signals produced in the signal output coupling means are subjected to the power composition by the branch lines 45 constituted by the transmission lines for output through the output connector OUT.

It is to be noted here that the branch line shown in FIG. 7 is so constructed that the electrical length from each output of the dielectric resonator (i.e. equivalent shortcircuit face of the resonator) to the first branch point a or b is an odd multiple of ¼ wavelength respectively, while the electrical length from the branch point a or b to another branch point at the second stage (i.e. the point where the central conductor of the output connector OUT is connected) is an integral multiple of ½ wavelength. By constructing the branch lines as described above, at a given frequency corresponding to one given resonator, the impedance obtained when viewing the other dielectric resonators from the respective branch points is extremely high, and thus, power can be fed from the output connector for that given channel with almost no loss in transmission power of its own channel.

Second Embodiment

FIGS. 9(A) to FIG. 11 show the radio frequency signal combining/sorting apparatus according to a second embodiment of the present invention.

Figure 9A:
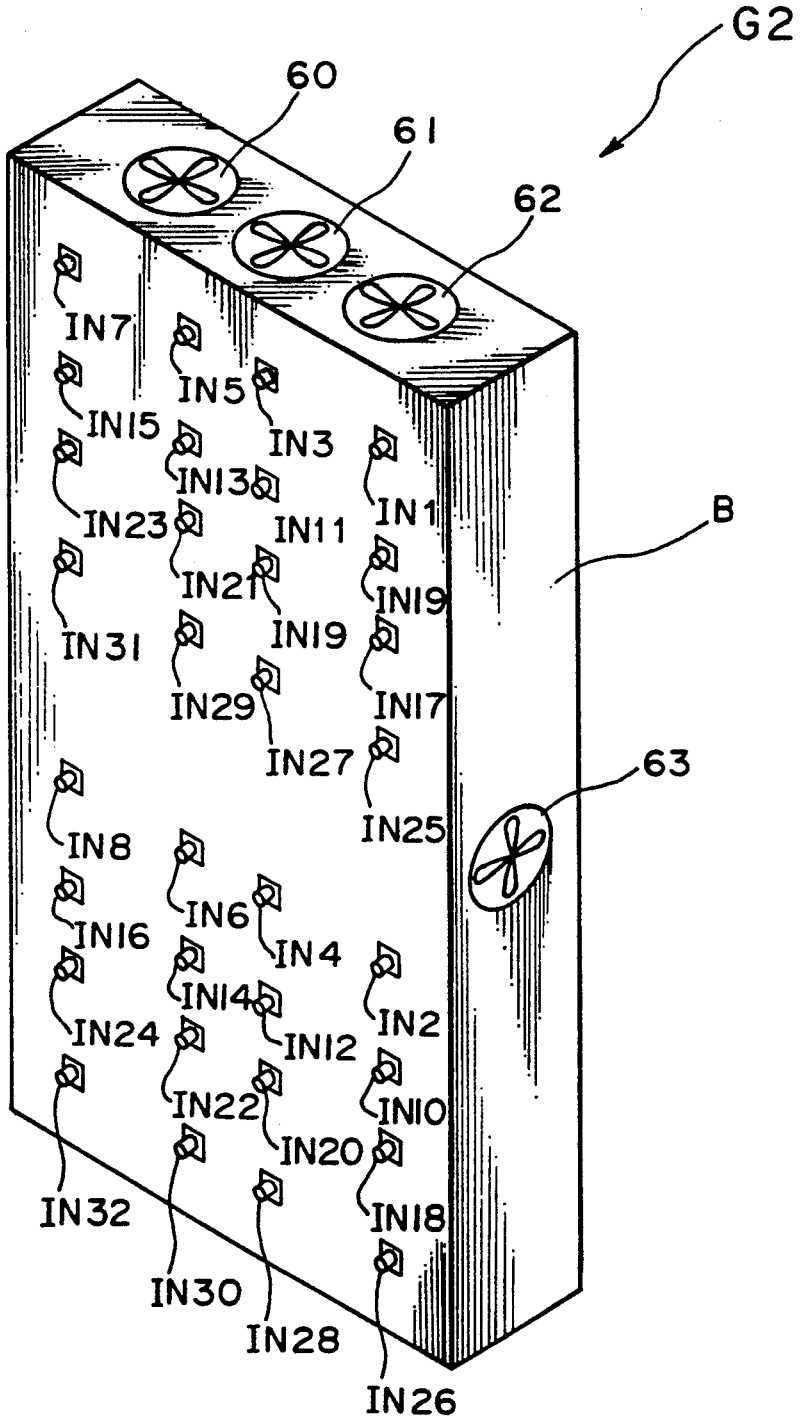
FIG. 9(A) is a perspective view of a radio frequency signal combining/sorting apparatus according to a second embodiment of the present invention as observed from its side where its signal input connectors are located.
Figure 9B:
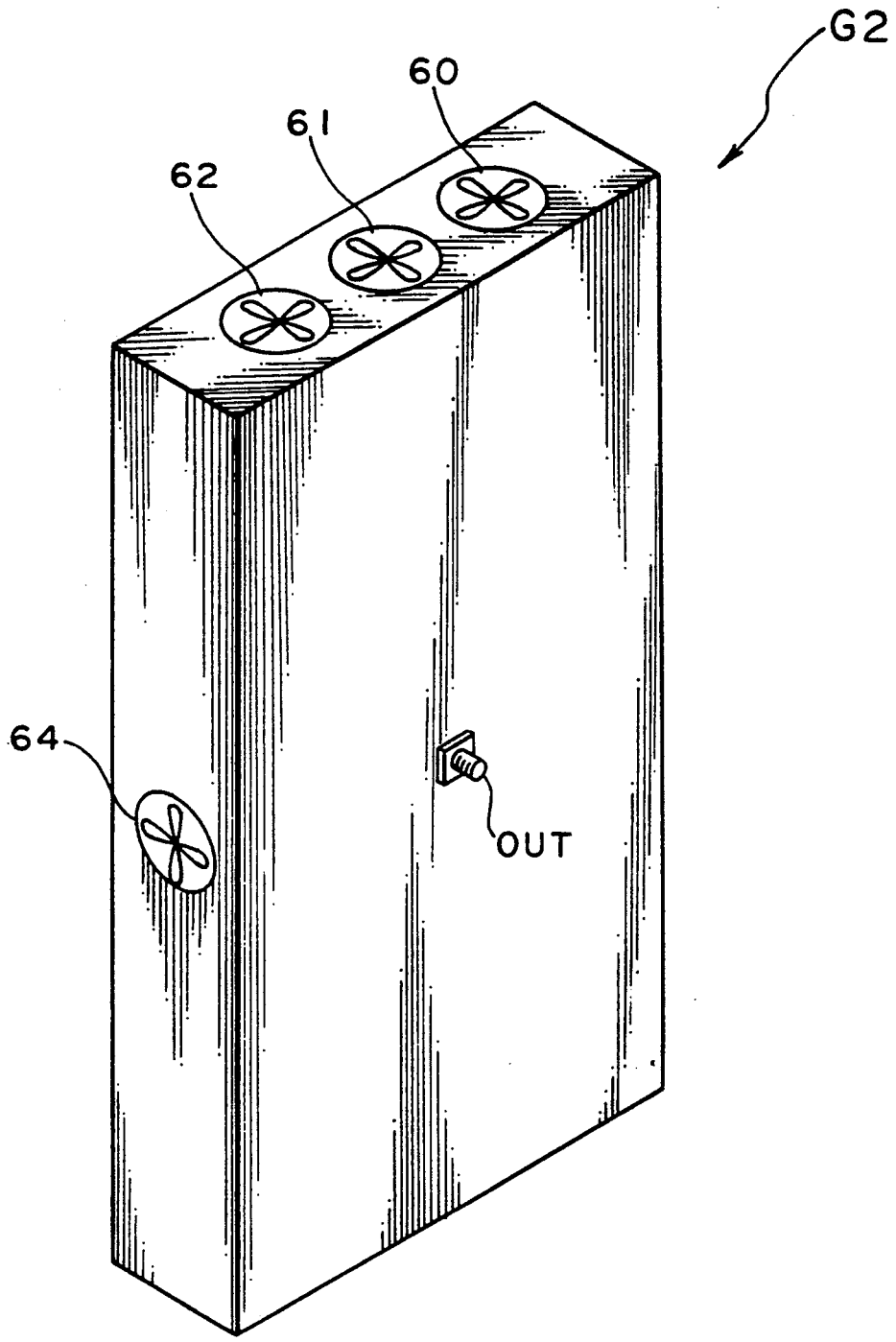
FIG. 9(B) is a similar view thereof as observed from its side where its signal output connector is located.

FIGS. 9(A) and 9(B) show the external appearance of a 32 channel radio frequency signal combining/sorting apparatus G2, in which FIG. 9(A) is a view as observed from the signal input connector side, and FIG. 9(B) is a view as observed from the signal output connector side of said apparatus. In FIGS. 9(A) and 9(B), on one surface of the main body B of the apparatus G2 (FIG. 9(A)), 32 input connectors IN1 to IN32 corresponding to the number of channels are arranged, in the same plane, on one major surface while on the opposite major surface thereof (FIG. 9 (B)), one output connector OUT is provided. Moreover, on the four side faces of the main body B of the apparatus G2 other than the opposite major surfaces provided with the signal input connectors IN1 to IN32 and the signal output OUT, a plurality of air cooling fans represented by numerals 60,61,62,63,64,65,66,67 etc. are mounted.

Figure 10:
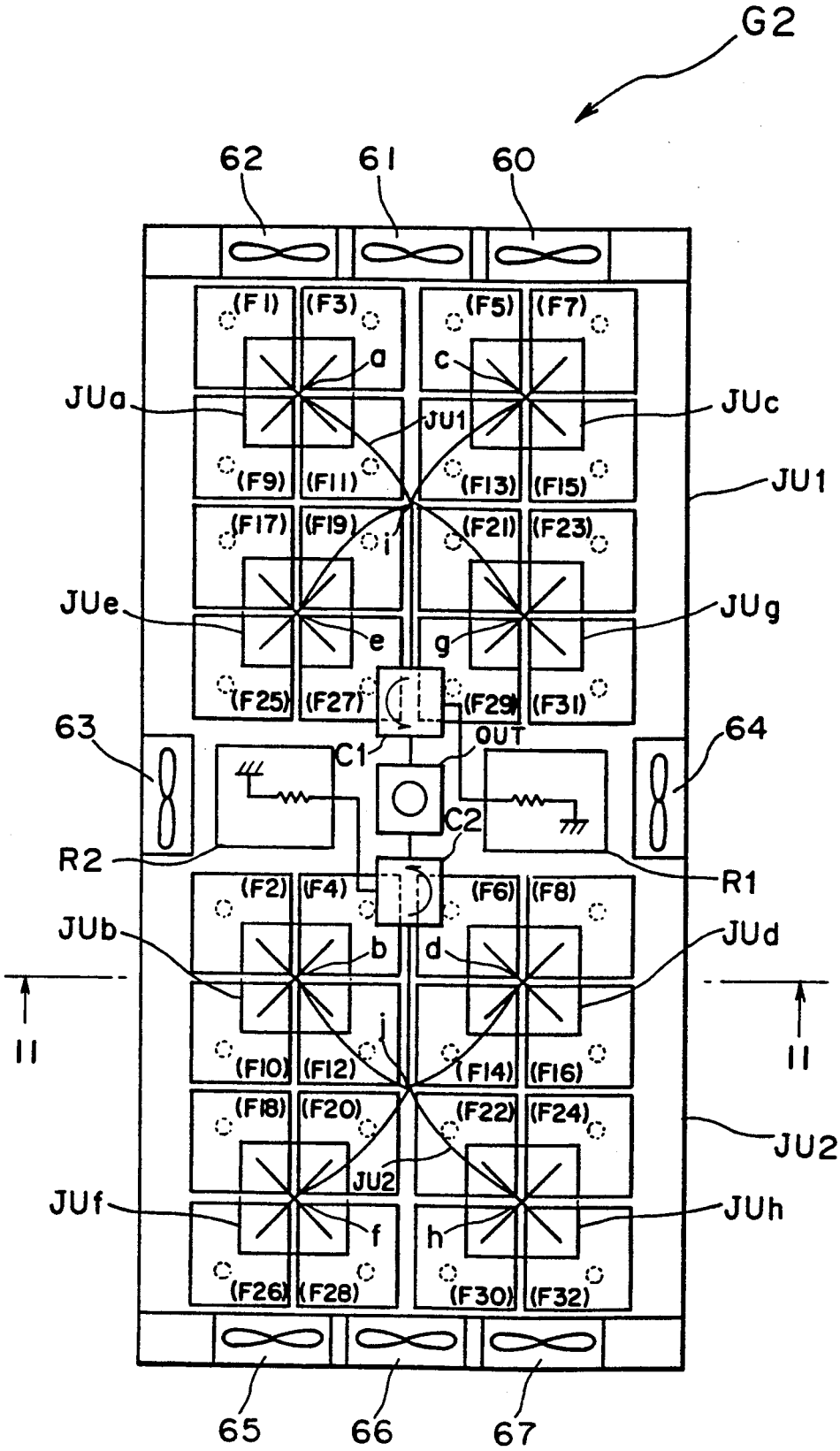
FIG. 10 is a schematic top plan view of the apparatus of FIGS. 9(A) and 9(B)
Figure 11:
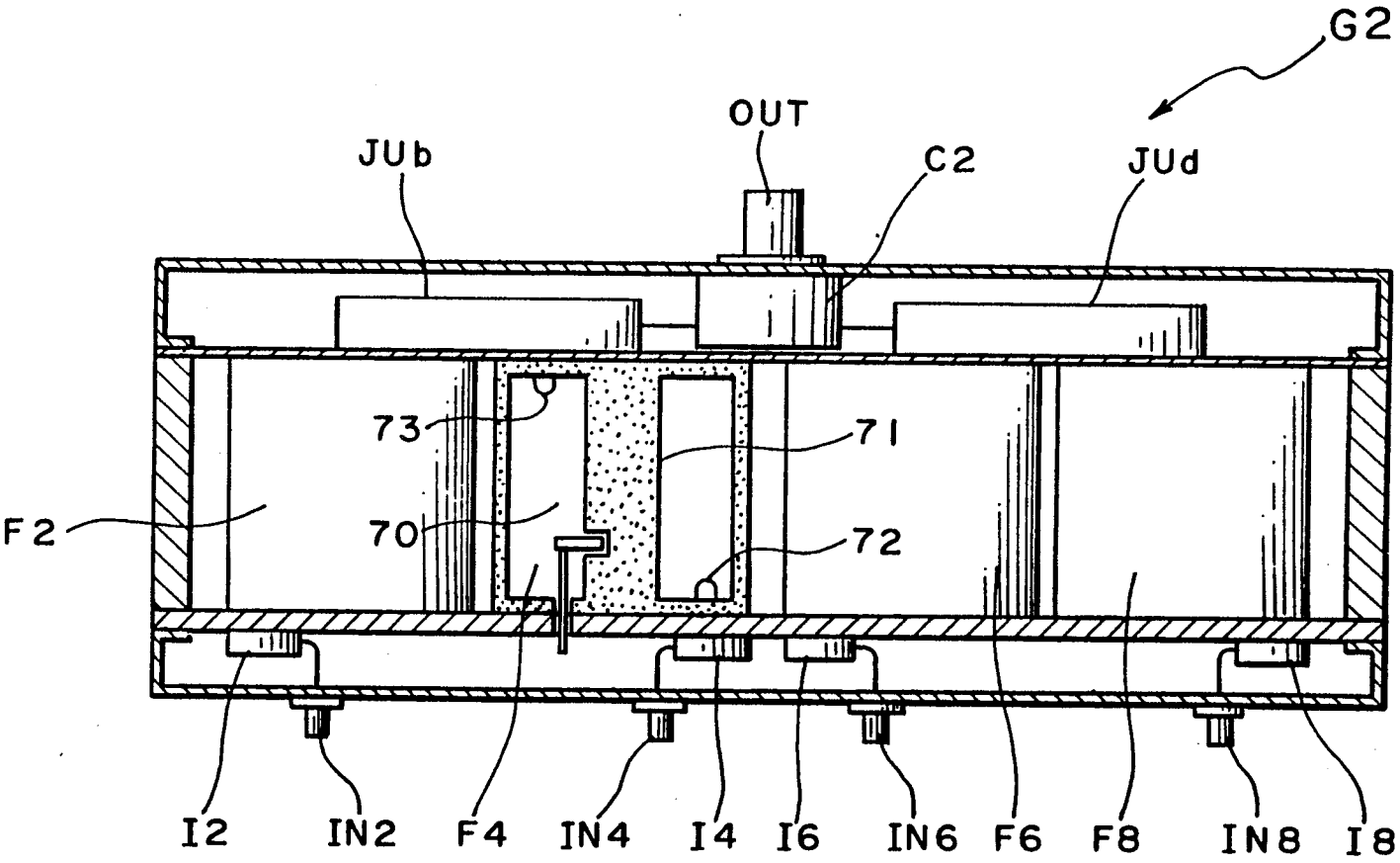
FIG. 11 is a schematic side sectional view of the apparatus of FIGS. 9(A) and 9(B)

FIG. 10 is a schematic top plan view showing the general construction in the interior of the combining/sorting apparatus G2, while FIG. 11 is a schematic side sectional view on an enlarged scale, taken along the line 11-11 in FIG. 10.

In FIG. 10, symbols F1 to F32 denote channel filters respectively composed of $TM_{010}$ mode dielectric resonators which allow band regions of the allocated channels to pass therethrough. The outputs of the odd numbered channel filters represented by F1 to F31 are composed into one output by the power composing circuit (referred to as a junction unit hereinafter) JU1 composed of branch lines. On the other hand, the respective outputs of the even numbered channel filters indicated by symbols F2 to F32 are composed into one output by the junction unit JU2. There are provided circulators C1 and C2 respectively connected with dummy loads R1 and R2. The circulator C1 is adapted to lead the output of the junction unit JU1 to the output connector OUT, while the circulator C2 leads the output of the junction unit JU2 to the output connector OUT.

Each of the symbols JUa to JUh represents a junction unit in which branch lines composed of the transmission lines are formed on the substrate, so as to compose four resonator outputs respectively. For example, the junction unit JUa composes the respective outputs of the resonators F1,F3,F9 and F11 at a point a. As another example, the junction unit Juh composes the respective outputs of the resonators F22, F24,F30 and F32 at a point h. The outputs of these junction units are composed by the branch lines JU1 and JU2 constituted by coaxial cables or the like and supplied to the circulators C1 and C2 respectively.

It is to be noted here that the branch lines of the junction units JUa to JUh are so constructed that the electrical length thereof from each resonator to the branch point is an odd multiple of ¼ wavelength. In the branch lines JU1 and JU2 for composing outputs of the respective junction units, the electrical length from the junction unit to the branch point i or j is an integral multiple of ½ wavelength.

In the junction unit JU1, the electrical length from the respective outputs of the channel filters F1,F3,F9 and F11 (equivalent short-circuiting faces of the respective resonators) to the first branch point a, the electrical length from the respective outputs of the channel filters F5,F7,F13 and F15 to the first branch point c, the electrical length from the respective outputs of the channel filters F17,F19,F25 and F27 to the first branch point e, and the electrical length from the respective outputs of the channel filters F21,F23,F29 and F31 to the first branch point g are respectively set to be odd multiples of ¼ wavelength. Similarly, in the junction filter unit JU2, the electrical length from the respective outputs of the channel filters F2,F4,F10 and F12 to the first branch point b, the electrical length from the respective outputs of the channel filters F6,F8,F14 and F16 to the first branch point d, the electrical length from the respective outputs of the channel filters F18,F20,F26 and F28 to the first branch point f, and the electrical length from the respective outputs of the channel filters F22,F24,F30 and F32 to the first branch point h are respectively odd multiples of ¼ wavelength. The electrical length from the branch points a,c,e and g to the branch point i at the second stage is an integral multiple of ½ wavelength. Similarly, the electrical length from the branch point b,d,f, and h to the branch point j at the second stage is set to be integer multiple of ½ wavelength.

By constructing the junction unit as described above, a given frequency for the design wavelength, the impedance when the other channels are viewed from the respective branch points is increased to a large extent, and the transmission power of the given channel is fed to the circulators C1 and C2 with almost no loss. Similarly, coupling attenuation amount with respect to other transmitters (i.e. circuitry for supplying transmission power to the channel filters through the respective isolators) is also increased, for consequent reduction of interference between the transmitters.

In the cross sectional view of FIG. 11, the internal construction is shown with respect to the channel filter F4 channel filters F2, F6 and F8 are also shown. In channel filter F4, a ceramic cavity 70 has a pillar-like inner dielectric member integrally formed between a bottom wall and a top wall of the cavity, whereby a $TM_{010}$ mode dielectric resonator is constituted. Signal input coupling loop 72 and signal output coupling loop 73 with respect to this resonator are provided on the bottom wall and top wall of said ceramic cavity 70. 32 channel filters having the construction as described above are accommodated in the metallic case. In FIG. 11, there are provided input connectors IN2,IN4,IN6 and IN8, and isolators I2,I4,I6 and I8 for supplying signals from the respective input connectors to the input coupling loops of the respective resonators (channel filters). The branch line in the junction unit JUb couples the respective outputs of the channel filters F2,F4,F10 and F12 (the outputs of the above coupling loops) as shown in FIG. 10, with the point b defined by an electrical length in the odd multiple of ¼ wavelength. The branch line in the junction unit JUd couples the respective outputs of the channel filters F6,F8,F14 and F16 as shown in FIG. 10, with the point d defined by an electrical length which is an odd multiple of ¼ wavelength. As discussed above, the branch line at the first stage thereof, is constituted by a pattern on the board, for example, as a strip line or transmission line, while the branch line at its second stage is constituted by a coaxial cable a the like.

By the foregoing arrangement, the signals inputted from the signal input connectors for the odd numbered channels, represented by the respective input connectors IN1 to IN31, are subjected to power composition by the four junction units and coaxial cable, etc. so as to be supplied to the circulator C1, and the signals inputted from the signal input connectors for the even numbered channels, represented by the respective input connectors IN2 to IN32, are subjected to power composition by the four junction units and coaxial cable etc. so as to be supplied to the circulator C2. Half of the input power to the circulators C1 and C2 is respectively absorbed by the dummy loads R1 and R2, and the composition signal is outputted from the output terminal OUT.

Air cooling fans 60 to 67 are provided to suppress temperature rise of the dielectric resonators by directly cooling the cavities of the 32 dielectric resonators. Particularly, the air cooling fans 63 and 64 suppress heat generation of the dummy loads R1 and R2. Since the respective dielectric resonators are each of the TM mode, with the inner dielectric member being directly in contact with the two faces of the cavity (i.e. by integral molding), the heat of the inner dielectric member is efficiently radiated from its surface through the cavity for reduction of the temperature rise in the inner dielectric member.

Accordingly, the frequency variation is stabilized, with a reduction of the insertion loss.

It should be noted here that, in the foregoing embodiments, although the dielectric resonators of a single mode are employed as the channel filters, the arrangement may, for example, be so modified as to use one multi-TM mode dielectric resonator as a multi-stage channel filter, or a channel filter for a plurality of channels.

Figure 12:
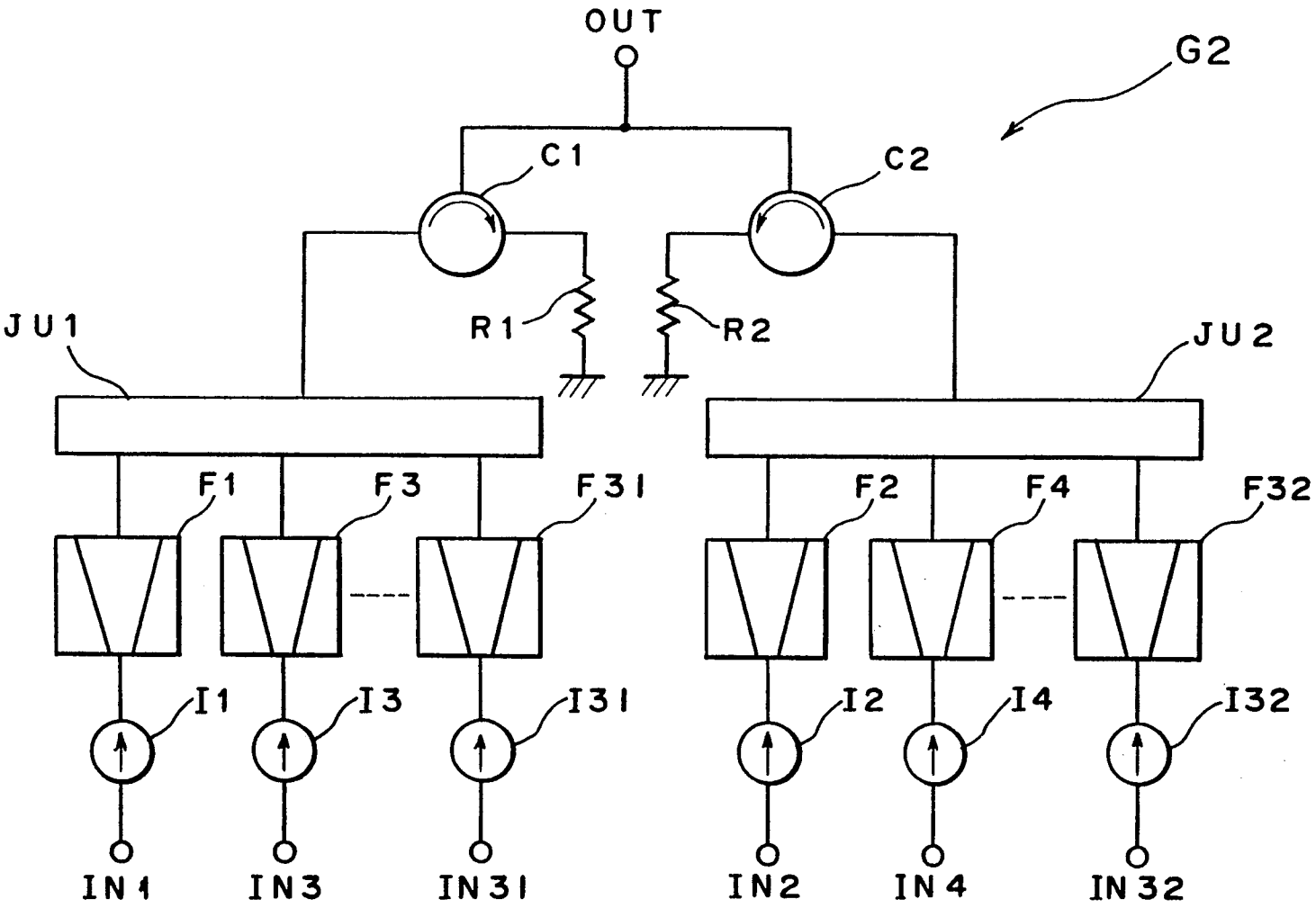
FIG. 12 is a schematic circuit diagram showing the general construction of the combining/sorting apparatus according to the second embodiment of the present invention.

FIG. 12 is a circuit diagram showing the general construction of the combining/sorting apparatus G2 according to the second embodiment as described so far.

In FIG. 12, the channels allocated to the channel filters F1 to F32 are equal to the numbers of said filters. More specifically, the junction unit JU1 composes the outputs of the channel filters F1 to F31 which allow the odd-numbered channels, to pass therethrough, while the junction unit JU2 composes the outputs of the channel filters F2 to F32 which cause the even-numbered channels to pass therethrough. The output of the junction unit JU1 passes through the circulator C1 so as to output ½ of its power from the output terminal OUT, and the remaining ½ of the power passes through the circulator C2 and is consumed by the dummy load R2. Meanwhile, the output of the junction unit JU2 passes through the circulator C2 so as to output ½ of its power from the output terminal OUT, and the remaining ½ of the power passes through the circulator C1 and is consumed by the dummy load R1.

Although the foregoing embodiments are related to the 32 channel radio frequency signal combining/sorting apparatus, in order to constitute a radio frequency signal combining/sorting apparatus with more channels, it may be so arranged to provide a plurality of sets of the combining/sorting apparatus having the circuit construction as described above, and to subject the outputs thereof to power composition by hybrid circuits.

Figure 13:
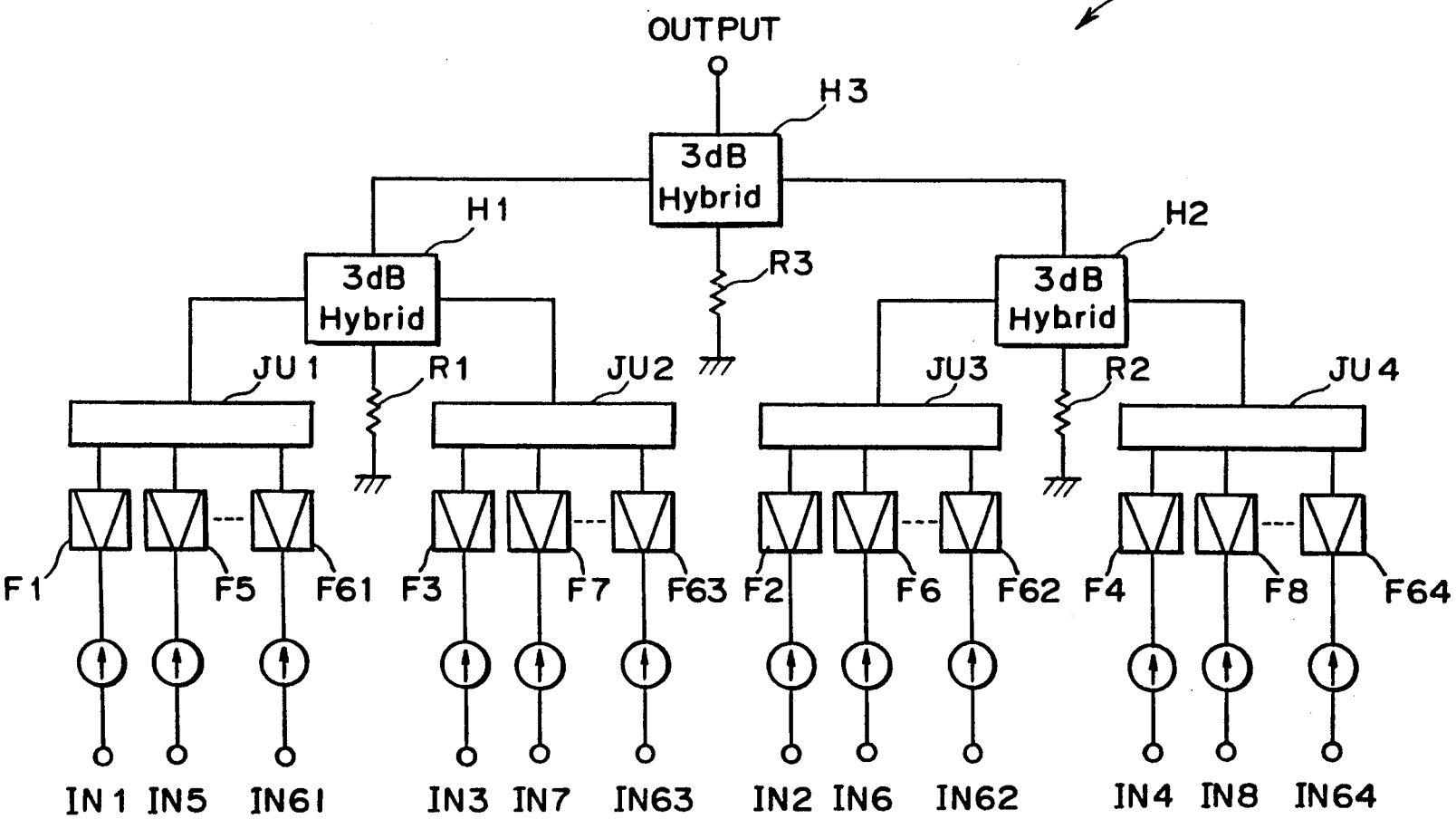
FIG. 13 is a circuit diagram similar to FIG. 12, which particularly shows a third embodiment of the invention, FIGS. 14(1) to 14(4) are characteristics of the respective channel filters of the apparatus of FIG. 13.

FIG. 13 shows one example of such circuit construction G3 as referred to above. In FIG. 13, channel filters F1 to F64 allow band regions of a number of channels equal to the number of filters to pass therethrough. Input terminals IN1 to IN64 respectively apply input signals to the respective channel filters through isolators. The junction unit JU1 is arranged to compose the output of the channel filters F1,F5,—and F61 into one output, the junction unit JU2 is adapted to compose the outputs of the channel filters F3,F7,—and F63, the junction unit JU3 is intended to compose the outputs of the channel filters F2,F6,—and F62, and the junction unit JU4 is to compose the outputs of the channel filters F4,F8,—and F64. H1,H2 and H3 represent 3dB hybrid circuits respectively having resistors R1,R2 and R3 as dummy loads. The 3dB hybrid circuit H1 composes the outputs of the two junction units JU1 and JU2, and the 3dB hybrid circuit H2 composes the outputs of other two junction units JU3 and JU4. Further, the 3dB hybrid circuit H3 composes the output of the hybrid circuits H1 and H2.

Figure 14:
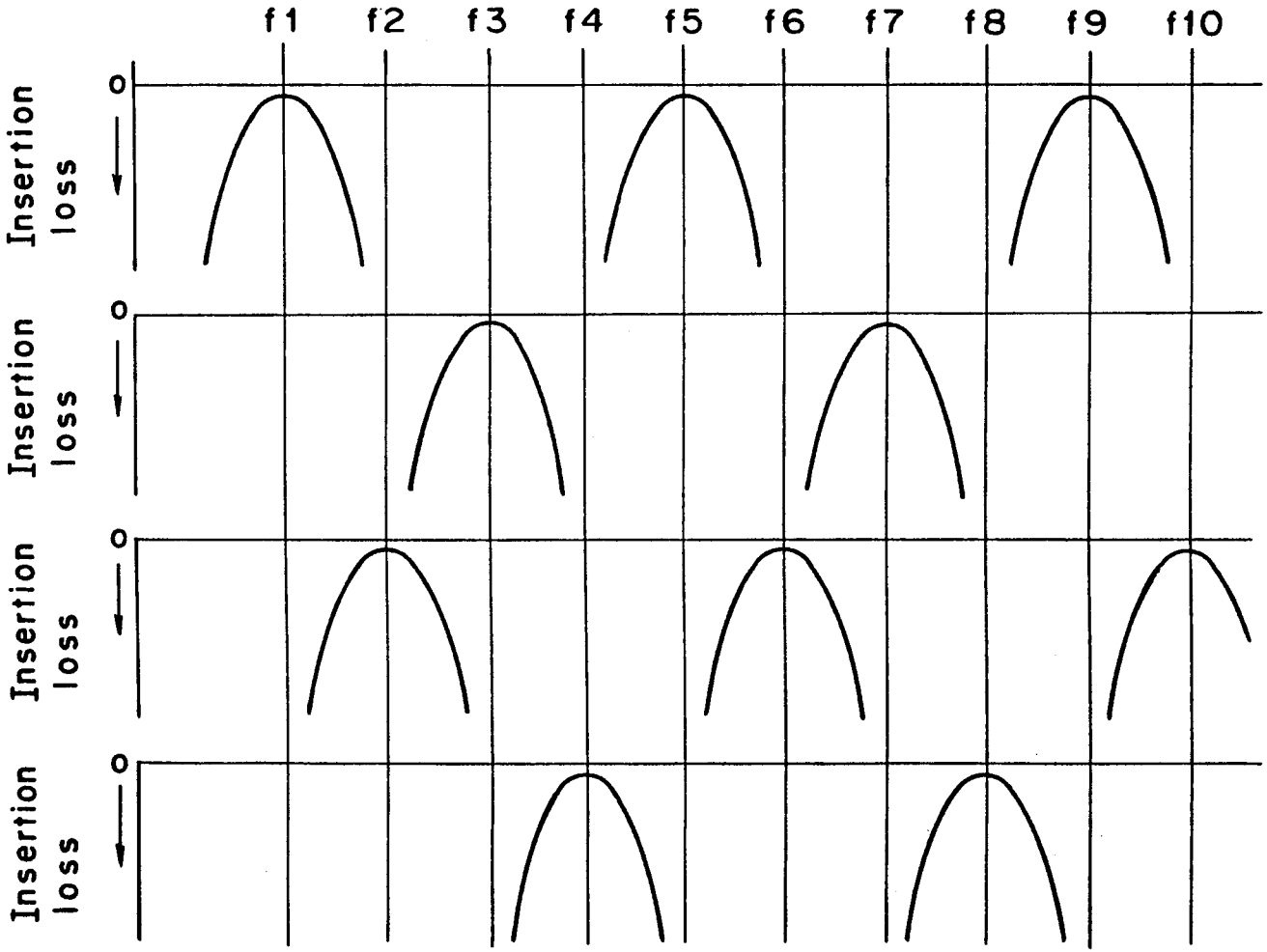
Figure 15:
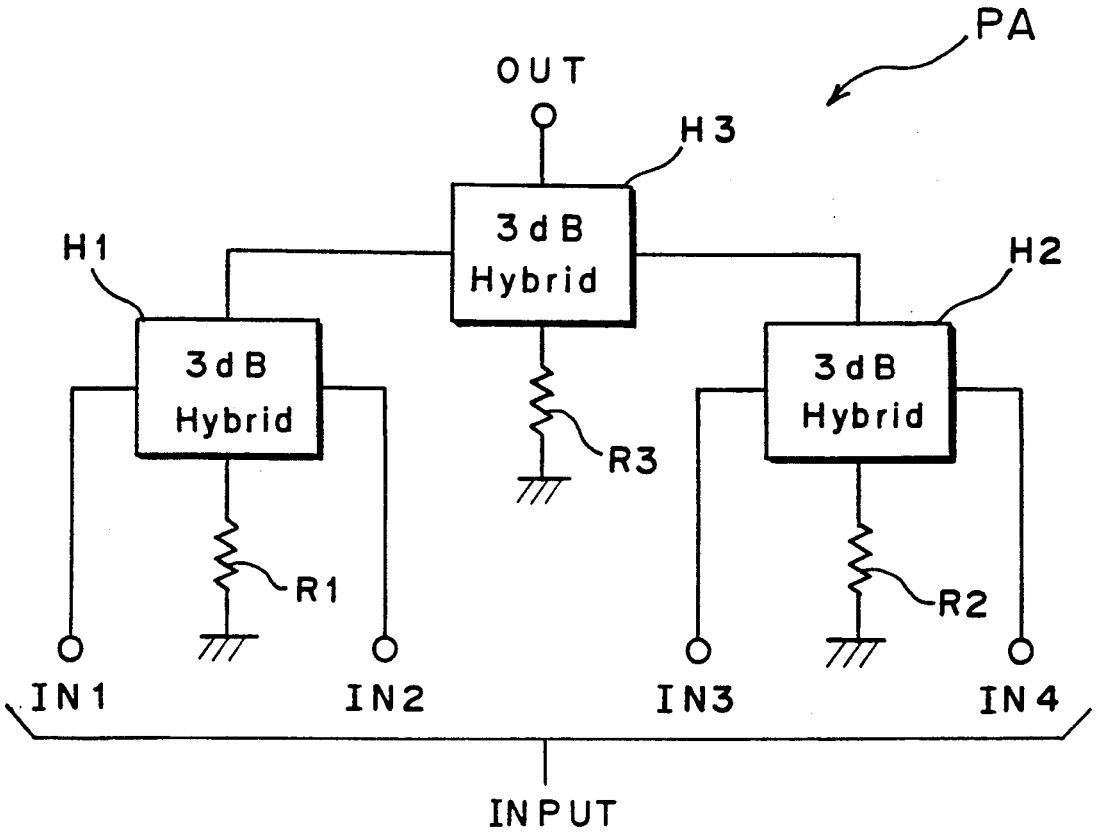
Fig. 15 PRIOR ART
FIG. 15 is a circuit diagram showing a conventional power composing system (already referred to)
Figure 16:
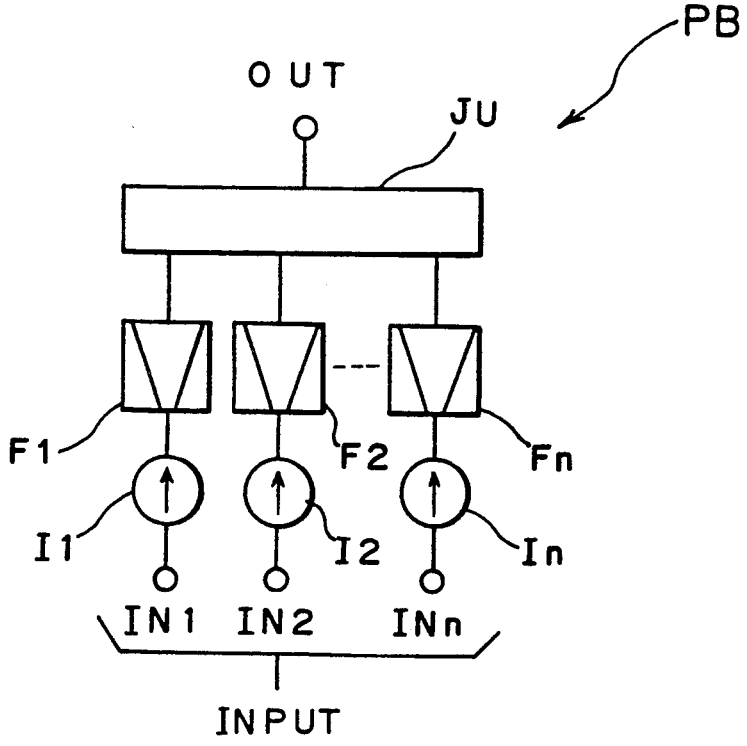
Fig. 16 PRIOR ART
FIG. 16 is a circuit diagram similar to FIG. 15, which particularly shows another conventional power composing system (already referred to)
Figure 17:
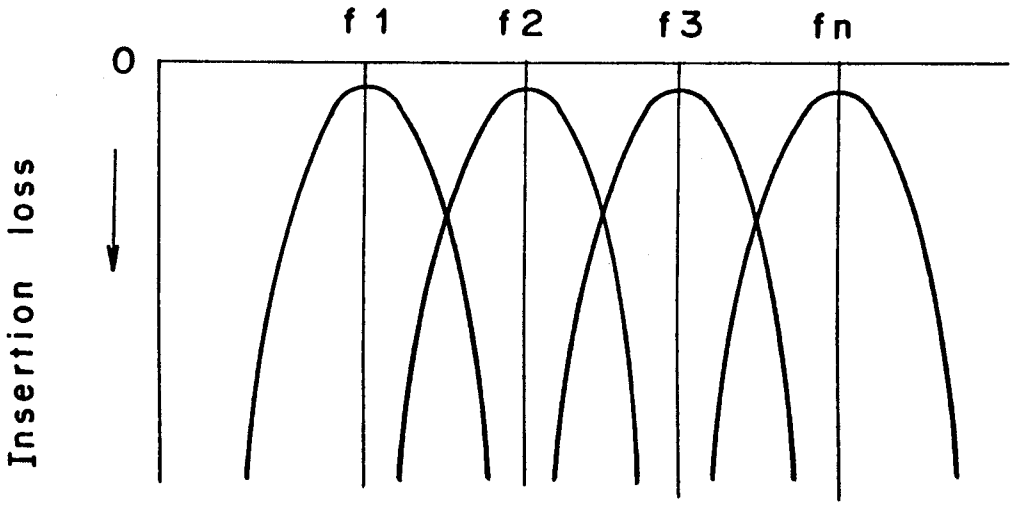
Fig. 17 PRIOR ART
FIG. 17 is a diagram showing transmission characteristics of the respective channel filters of the system in FIG. 15 (already referred to).

FIGS. 14(1) to 14(4) are diagrams showing channels allocated to the respective channel filters shown in FIG. 13, and the transmission characteristics. In FIGS. 14(1) to 14(4), the transmission characteristics of the respective channel filters for applying signals to the junction units JU1 to JU4 are shown. By connecting the filters so that the band regions of the channel filters connected to the respective junction units are most spaced from each other, interference between the respective channel filters and the respective transmitters connected thereto is reduced to the minimum.

As is clear from the foregoing description, according to one aspect of the present invention, the passband regions of the channel filters to be connected to one power composing circuit consisting of the branch line is permitted wider than the channel interval. Therefore, the apparatus is less affected by the Q value and the frequency temperature stability, and thus, it becomes possible to achieve the low insertion loss composition. Moreover, even in the case where channel filters provided with conventional Q value and frequency temperature stability are employed, a large number of channels set at a narrow channel interval may be transmitted, without increasing the insertion loss.

Furthermore, in another aspect of the present invention, since a TM mode dielectric resonator is employed as channel filter, it is possible to achieve compact size, with a comparatively high Q value provided. Moreover, by forming the junction unit with the branch line of the transmission line and the signal output coupling means as part of the channel filter unit, a further reduction in size may be achieved. Another advantage of the apparatus of the present invention is that, since each channel filter is constituted by a TM mode dielectric resonator, high heat radiating efficiency is achieved, with the temperature rise being suppressed and remaining low. Accordingly, the combining/sorting apparatus, compact in size, and low in insertion loss and cost, can be advantageously employed for the base stations of the cellular system having a reduced cell radius.

Although embodiments of the present invention have been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A radio frequency signal combining/sorting apparatus which comprises:

a channel filter unit comprising a plurality of TM mode dielectric resonators respectively adapted to allow band regions of specific channels to pass therethrough, and each said resonator having a respective hole for receiving a resonator signal input coupling means, and a respective hole for receiving a resonator signal output coupling means, said dielectric resonators having a common plane which contains at least said resonator signal output coupling means receiving holes, and a junction unit having a circuit board with resonator signal output coupling means which project from the surface of said circuit board for conducting an output signal from each of said resonators, and having branched lines including transmission lines for combining outputs of said resonator signal output coupling means, said junction unit being combined with said channel filter unit by locating said resonator signal output coupling means in said resonator signal output coupling means receiving holes at said common plane, to constitute said radio frequency signal combining/sorting apparatus, wherein said transmission channels consist of a predetermined plurality of channels which are separated by a given channel spacing, and no two adjacent channels are both applied to any given branched line.

2. An apparatus as claimed in claim 1, wherein said circuit board comprises an upper plate and a lower plate and said transmission lines are disposed between said upper and lower plates.

3. An apparatus as claimed in claim 1 wherein said transmission lines are disposed in a groove formed in one of said plates.

4. An apparatus as claimed in claim 2, wherein each said transmission line comprises a tri-plate type transmission line.

5. An apparatus as claimed in claim 4, wherein each said tri-plate type transmission line is formed by an electrode layer on a first one of said plates, dielectric means on said electrode layer, and a strip electrode on said dielectric means.

6. An apparatus as claimed in claim 5, further comprising an output connector for conducting the output of said combining/sorting apparatus, the output connector being conductively connected to one of said transmission lines via an aperture in the other of said upper and lower plates.

7. An apparatus as claimed in claim 5, wherein each said resonator signal output coupling means is conductively connected to one of said transmission lines via an aperture in the first plate and an aperture formed by the dielectric means of said one transmission line.

8. An apparatus as claimed in claim 1, wherein said transmission lines are within said circuit board, and further comprising an output connector for conducting the output of said combining/sorting apparatus, the output connector being conductively connected to one of said transmission lines via an aperture in said circuit board.

9. An apparatus as claimed in claim 8, wherein said resonator signal output coupling means is conductively connected to one of said transmission lines via an aperture in said circuit board.

10. An apparatus as claimed in claim 1, wherein said transmission liens are within said circuit board, and said resonator signal output coupling means is conductively connected to one of said transmission lines via an aperture in said circuit board.

11. A radio frequency signal combining/sorting apparatus which comprises:

a plurality of channel filters which allow band regions of respective transmissions channels to pass therethrough;

isolators which receive said transmission channels and have outputs connected to respective inputs of said channel filters;

a plurality of power combining circuits, each connected for combining outputs of certain ones of said channel filters into one output; and an output circuit arranged to combine the outputs of said power combining circuits;

the band regions of said respective channel filters being selected so that the band regions of the respective channel filters of a given power combining circuit are spaced from each other;

wherein said transmission channels consist of a predetermined plurality of channels which are separated by a given channel spacing, and no two adjacent channels are both applied to any given power combining circuit; and wherein said output circuit comprises at least one 3dB hybrid circuit.

12. An apparatus as in claim 11, wherein each two of said power combining circuits deliver their outputs to one said 3dB hybrid circuit.

13. An apparatus as in claim 12, wherein there are two of said power combining circuits and each of said channel filters delivers its output to one of said two power combining circuits.

14. An apparatus as in claim 12, wherein there are at least four of said power combining circuits and at least two of said 3dB hybrid circuits, one for each respective pair of said power combining circuits.

15. An apparatus as in claim 14, wherein said at least two 3dB hybrid circuits deliver their outputs to a third 3dB hybrid circuit.

16. An apparatus as in claim 15, wherein said third 3dB hybrid circuit delivers said one output of said apparatus.

17. An apparatus as in claim 14, wherein there are four of said power combining circuits and each of said channel filters delivers its output to one of said four power combining circuits.

18. A radio frequency signal combining/sorting apparatus which comprises:

a plurality of channel filters which allow band regions of respective transmission channels to pass therethrough;

isolators which receive said transmission channels and have outputs connected to respective inputs of said channel filters;

a plurality of power combining circuits, each connected for combining outputs of certain ones of said channel filters into one output; and an output circuit arranged to combine the outputs of said power combining circuits;

the band regions of said respective channel filters being selected so that the band regions of the respective channel filters of a given power combining circuit are spaced from each other;

wherein said transmission channels consist of a predetermined plurality of channels which are separated by a given channel spacing, and no two adjacent channels are both applied to any given power combining circuit; and wherein said output circuit comprises at least one circulator.

19. An apparatus as in claim 18, wherein each said power combining circuit delivers its output to one said circulator.

20. An apparatus as in claim 19, wherein there are two of said power combining circuits and each of said channel filters delivers its output to one of said two power combining circuits.

21. An apparatus as in claim 19, wherein there are two said power combining circuits and two respective circulators, and the outputs of said circulators are combined to produce said one output of said apparatus.

* * * * *